US007800492B2

(12) United States Patent
Olson

(10) Patent No.: US 7,800,492 B2
(45) Date of Patent: Sep. 21, 2010

(54) MULTI PURPOSE LOCATER

(76) Inventor: Vicky L. Olson, P.O. Box 301, Bentley, AB (CA) T0C 0J0

( * ) Notice: Subject to any disclaimer, the term of this patent is extended or adjusted under 35 U.S.C. 154(b) by 541 days.

(21) Appl. No.: 11/786,317

(22) Filed: Apr. 11, 2007

(65) Prior Publication Data

US 2007/0247309 A1 Oct. 25, 2007

Related U.S. Application Data

(60) Provisional application No. 60/794,581, filed on Apr. 24, 2006.

(51) Int. Cl.
*G08B 1/08* (2006.01)

(52) U.S. Cl. ..... 340/539.1; 340/539.13; 340/539.11

(58) Field of Classification Search ..... 340/539.12, 340/539.1, 539.11, 539.13, 691.1, 692, 539.32
See application file for complete search history.

(56) References Cited

U.S. PATENT DOCUMENTS 5,939,981 A * 8/1999 Renney ..... 340/539.32
6,674,364 B1 * 1/2004 Holbrook et al. ..... 340/568.1
6,774,787 B1 * 8/2004 Melbourne ..... 340/539.1
2004/0017293 A1 * 1/2004 Webster ..... 340/539.32
2005/0168338 A1 * 8/2005 Parker et al. ..... 340/539.32

* cited by examiner

*Primary Examiner*—Toan N Pham
(74) *Attorney, Agent, or Firm*—Raymond M. Galasso; Galasso & Associates, L.P.

(57) ABSTRACT

Multi Purpose Locater is a transmitter and receiver system designed to allow a user to more easily find small objects such as keys, beepers, cell phones or glasses. The preferred embodiment of Multi Purpose Locater is comprised of at least some of the following: a transmitter, microchip and power source located inside a small plastic housing with an adhesive backing in combination with a receiver, power source and sound mechanism located inside another plastic housing and a speaker and power button on that plastic housing. To use Multi Purpose Locater, an individual attaches the transmitter housing to an object using the adhesive backing. The transmitter within the transmitter housing constantly emits a signal detectable by the accompanying receiver located in the receiver housing. When the object is misplaced, the user turns on the receiver using the power button located on the receiver housing. When the receiver detects the proper frequency from the transmitter, the sound mechanism sounds an alarm through the speaker located on the receiver housing.

16 Claims, 1 Drawing Sheet

MULTI PURPOSE LOCATER

CROSS REFERENCE TO RELATED APPLICATIONS

This U.S. Non-Provisional Patent Application claims priority to U.S. Provisional Patent Application No. 60/794,581 entitled "Multi Purpose Locater" filed Apr. 24, 2006.

FIELD OF THE DISCLOSURE

The disclosures made herein relate generally to the automobile and electronics accessories industries. The invention discussed herein is in the general classification of transmitters and receivers for locating objects.

BACKGROUND

Many individuals carry a variety of accessories with them when they leave their house or apartment. These individuals must constantly monitor their possessions or risk having them stolen or misplaced. Necessities such as keys and glasses are part of almost everyone's daily life. Cell phones, beepers, portable music players and other electronic gadgets are also becoming increasingly popular in the United States. An individual frequently misplaces these items due to the diminutive nature of them. To find these objects, an individual must retrace his steps and spend countless amounts of time and effort. No effective device has been created to constantly monitor objects and allow an individual to find misplaced objects with a minimal amount of effort and expenditure of time.

Hence, there is a need in the art for a convenient to use, inexpensive, durable, safe and effective device for aiding an individual in locating small objects.

SUMMARY OF THE DISCLOSURE

Multi Purpose Locater is a transmitter and receiver system designed to allow a user to more easily find small objects such as keys, beepers, cell phones or glasses.

The preferred embodiment of the invention utilizes a transmitter, microchip and power source located inside a small plastic housing with an adhesive backing in combination with a receiver, power source and sound mechanism located inside another plastic housing and a speaker and power button on that plastic housing.

Other embodiments of the invention may have a power switch on the transmitter housing to allow the user to control the power to conserve batteries, if desired.

The principal object of this invention is to provide a device to aid an individual in locating small objects such as keys, beepers, cell phones or glasses.

Another object of this invention is to provide a device that saves an individual time by allowing him to use a receiver to locate a transmitter attached to a misplaced object.

Another object of this invention is to provide a device to constantly monitor various objects.

Another object of this invention is to provide an affordable device to aid an individual in locating small objects such as keys, beepers, cell phones or glasses.

Another object of this invention is to provide a safe device to aid an individual in locating small objects such as keys, beepers, cell phones or glasses.

Yet another object of this invention is to provide a durable device to aid an individual in locating small objects such as keys, beepers, cell phones or glasses.

DETAILED DESCRIPTION OF THE DRAWINGS

The preferred embodiment of Multi Purpose Locater is comprised of at least some of the following: a transmitter, microchip and power source located inside a small plastic housing with an adhesive backing in combination with a receiver, power source and sound mechanism located inside another plastic housing and a speaker and power button on that plastic housing.

Figure 1:
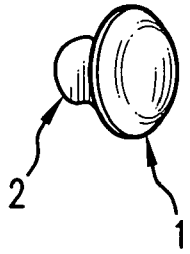
FIG. 1 depicts a perspective view of the preferred embodiment of the housing of the transmitter of the present invention.

FIG. 1 depicts a perspective view of the preferred embodiment of the housing of the transmitter of the present invention. A transmitter housing 1 made of plastic covers a transmitter (not shown) and a microchip (not shown). A battery (not shown) is also located within the transmitter housing 1 and is operatively connected to the transmitter. The transmitter housing 1 is circular and has a diameter of approximately one inch and a width of half an inch in this preferred embodiment though the size is not critical. Ideally, the transmitter housing would be small enough to be placed on objects such as beepers and key rings.

On the back of the transmitter housing 1 a peel-off backing 2 covers an adhesive layer. The peel-off backing 2 is also circular and made of plastic and is designed to cover almost the entirety of the backing of the transmitter housing 1. Ideally, the peel-off backing 2 is thin enough to not appreciably add to the thickness of the transmitter housing 1.

Figure 2:
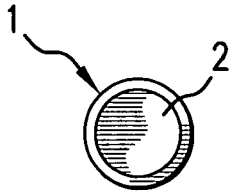
FIG. 2 depicts a rear view of the preferred embodiment of the housing of the transmitter of the present invention.

FIG. 2 depicts a rear view of the preferred embodiment of the housing of the transmitter of the present invention. The peel-off backing 2 of the transmitter housing 1 can be seen in greater detail. As described in conjunction with FIG. 1, the peel-off backing 2 is designed to cover a large amount of the surface area of the transmitter housing 1 to maximize its ability to adhere to other objects.

Figure 3:
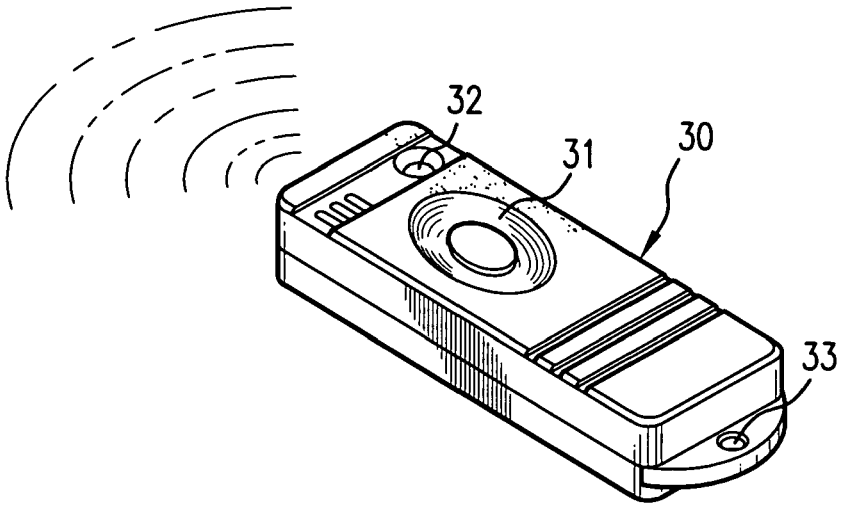
FIG. 3 depicts a perspective view of the preferred embodiment of the housing of the receiver of the present invention.

FIG. 3 depicts a perspective view of the preferred embodiment of the housing of the receiver of the present invention. A receiver housing 30 covers a receiver (not shown), sound mechanism (not shown) and battery (not shown). The receiver housing 30 is approximately rectangular and made of plastic. The receiver housing 30 is approximately three inches long, one and half inches wide and half an inch thick in this preferred embodiment though the exact size and shape is not critical.

The receiver is operatively connected to the sound mechanism and to the battery. The sound mechanism is operatively connected to a speaker 31 on the exterior of the receiver housing 30. The speaker 31 is approximately circular with a one-inch diameter in this preferred embodiment. When the receiver detects the proper frequency from an accompanying transmitter, it sends a signal to the sound mechanism, causing an audible beep through the speaker 31.

A power button 32 is also located on the exterior of the receiver housing 30 to permit a user to conserve power when the receiver is not in use. An attaching mechanism 33 in a semi-circular shape is located on one end of the receiver housing 30 to allow it to be attached to a key ring or the like.

Figure 4:
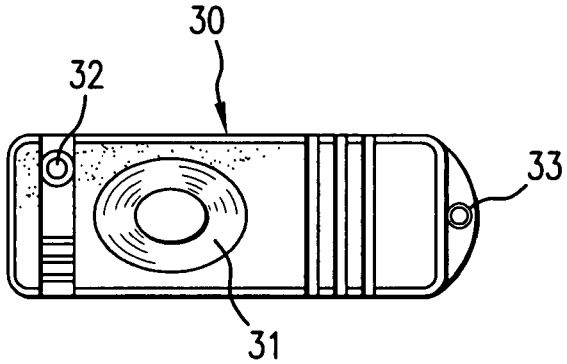
FIG. 4 depicts an aerial view of the preferred embodiment of the housing of the receiver of the present invention.

FIG. 4 depicts an aerial view of the preferred embodiment of the housing of the receiver of the present invention. The speaker 31, power button 32 and attaching mechanism 33 on the receiver housing 30 are all visible from this angle.

In other embodiments of the invention, a power button could also be located on the transmitter housing to permit a user to conserve power.

To use Multi Purpose Locater, an individual attaches the transmitter housing to an object using the adhesive backing. The transmitter within the transmitter housing constantly emits a signal detectable by the accompanying receiver located in the receiver housing. When the object is misplaced, the user turns on the receiver using the power button located on the receiver housing. When the receiver detects the proper frequency from the transmitter, the sound mechanism sounds an alarm through the speaker located on the receiver housing.

The materials utilized for Multi Purpose Locater may vary widely but will likely include metals, plastic and electronics components. The metals would ideally be selected from available steel or alloys of steel and aluminum. The production process related to the use of these metals insures that the metal is non-corrosive, durable and strong. The selected metal should have high impact strength and be capable of accepting and retaining coloring materials for an extended length of time.

The plastic used in the production will ideally be selected for durability and longevity. Thermoplastics are commonly used in the manufacturing of components similar to those used in this invention. Polyethylene, polypropylene, and other similar thermoplastic materials would be among those with the necessary traits. Members of this family are recognized universally as being versatile and of high quality.

The plastic components of Multi Purpose Locater can also be formed with the use of plastic molding techniques, such as injection molding or blow molding. Injection molding requires melted plastic to be forcefully injected into relatively cool molds. As the plastic begins to harden, it takes on the shape of the mold cavity. This technique is ideal for the mass production of products. Alternatively, blow molding, a form of extrusion, could be utilized. Blow molding involves a molten tube being pushed into a mold. Compressed air then forces the molten tube against the cold walls of the mold.

All electronic components of the invention will also be ideally selected from those currently having the highest industry ratings. These components will also meet and/or exceed all safety and usage regulations. Wiring and associated connecting hardware should be insulated and otherwise protected from intrusion by any harmful or degrading elements, including water, medium level temperatures, and low to medium impact force.

It should be obvious that the components of the present invention can be of various shapes and sizes. It should also be obvious that the components of the invention can be made of different types of metals, plastics or other suitable materials and can be of any color.

It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. An object locater system, comprising:

a transmitter housing containing a transmitter; wherein said transmitter emits a continuous signal;

a first power source compartment located within the transmitter housing and operatively connected to the transmitter;

an adhesive layer on the transmitter housing;

a receiver housing containing a receiver;

a second power source compartment located within the receiver housing and operatively connected to the receiver;

a sound mechanism operatively connected to the receiver;

a speaker operatively connected to the sound mechanism; and a power button located on the receiver housing and operatively connected to the second power source compartment.

2. The system of claim 1 wherein the transmitter housing is made of plastic.

3. The system of claim 1 wherein the transmitter housing is approximately circular.

4. The system of claim 1 wherein the first power source compartment contains a battery.

5. The system of claim 1 further comprising a peel-off backing covering the adhesive layer.

6. The system of claim 5 wherein the peel-off backing is made of plastic.

7. The system of claim 5 wherein the peel-off backing is circular.

8. The system of claim 1 wherein the receiver housing is approximately rectangular.

9. The system of claim 1 wherein the receiver housing is made of plastic.

10. The system of claim 1 further comprising a power button located on the transmitter housing and operatively connected to the first power source compartment.

11. The system of claim 1 wherein the second power source compartment contains a battery.

12. The system of claim 1 further comprising an attaching mechanism located on the receiver housing.

13. The system of claim 12 wherein the attaching mechanism is semi-circular with a centrally located hole to accommodate a standard key ring.

14. The system of claim 1 wherein the speaker is approximately circular.

15. The system of claim 1 further comprising a microchip located within the transmitter housing.

16. An object locater system comprising a transmitter housing made of plastic that is approximately circular and contains a transmitter; wherein said transmitter emits a continuous signal;

a microchip located within the transmitter housing;

a first power source compartment located within the transmitter housing and operatively connected to the transmitter;

an adhesive layer on the transmitter housing;

a peel-off backing that is approximately circular and made of plastic that covers the adhesive layer;

a receiver housing that is approximately rectangular and made of plastic that contains a receiver;

a second power source compartment located within the receiver housing and operatively connected to the receiver;

a first power button located on the transmitter housing and operatively connected to the first power source compartment;

a second power button located on the receiver housing and operatively connected to the second power source compartment;

a sound mechanism located within the receiver housing and operatively connected to the receiver;

a speaker on the receiver housing that is approximately circular and operatively connected to the sound mechanism; and an attaching mechanism on the receiver, housing that is approximately semi-circular having a centrally located hole.

* * * * *